US007071884B2

(12) United States Patent
Choi

(10) Patent No.: US 7,071,884 B2
(45) Date of Patent: Jul. 4, 2006

(54) ANTENNA SYSTEM OF A RADIO COMMUNICATION TERMINAL

(75) Inventor: Tae-Kyu Choi, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 73 days.

(21) Appl. No.: 10/649,954

(22) Filed: Aug. 28, 2003

(65) Prior Publication Data

US 2004/0058655 A1 Mar. 25, 2004

(30) Foreign Application Priority Data

Sep. 12, 2002 (KR) ..... 10-2002-0055338

(51) Int. Cl.
*H01Q 1/24* (2006.01)
*H01Q 17/00* (2006.01)

(52) U.S. Cl. ..... 343/702; 455/127.1; 455/572

(58) Field of Classification Search ..... 343/702, 343/700 MS, 789, 872; 455/403, 456, 561, 455/127.1, 572
See application file for complete search history.

(56) References Cited

U.S. PATENT DOCUMENTS 5,513,176 A * 4/1996 Dean et al. ..... 370/335
5,828,339 A * 10/1998 Patel ..... 343/700 MS
6,549,177 B1 * 4/2003 Noro et al. ..... 343/895
6,664,928 B1 * 12/2003 Ogawa et al. ..... 343/700 MS
6,791,495 B1 * 9/2004 Chang et al. ..... 343/700 MS
6,812,824 B1 * 11/2004 Goldinger et al. ..... 340/10.1
6,823,180 B1 * 11/2004 Reed et al. ..... 455/305

FOREIGN PATENT DOCUMENTS

| | | |
|---|---|---|
| JP | 2001-156720 | 8/2001 |
| KR | 10-2000-36179 | 6/2000 |
| KR | 2001-0025591 | 4/2001 |
| KR | 2001-0038980 | 5/2001 |
| KR | 2002-0038428 | 5/2002 |
| WO | WO 02/39544 A1 | 5/2002 |

OTHER PUBLICATIONS

Copy of Korean Office Action dated Mar. 30, 2005.
Chinese Office Action dated Jul. 22, 2005 in Chinese Patent Application No. 03158122.6 with English Translation.

* cited by examiner

*Primary Examiner*—Don Wong
*Assistant Examiner*—Huedung X. Cao
(74) *Attorney, Agent, or Firm*—Fleshner & Kim LLP

(57) ABSTRACT

An antenna system of a radio communication terminal includes: a directional antenna for transmitting and receiving an RF signal to and from a base station through a radio link; and an amplifying unit integrated on one board together with the directional antenna and amplifying and filtering the RF signal. A transmistivity of a radio communication terminal is improved, a loss according to a transmission path between an antenna and the radio communication terminal can be compensated, and a speech quality can be maintained by above a certain level even in an area remote from a base station.

15 Claims, 4 Drawing Sheets

ANTENNA SYSTEM OF A RADIO COMMUNICATION TERMINAL

BACKGROUND OF THE INVENTION

1. Field of the Invention

The present invention relates to a radio communication terminal and, more particularly, to an active antenna system of a radio communication terminal that is capable of improving a speech quality of a radio communication terminal in an area where a radio environment is degraded and speech quality is adversely affected.

2. Background of the Related Art

In general, a radio communication allows a terminal and a base station to exchange information such as a signal, a code, a voice, a data or the like through a radio link, for which a radio communication terminal converts data into a radio signal by using a transmission circuit and transmits it through an antenna and extracts an effective data from a radio signal received by the antenna by using a reception circuit.

FIG. 1 illustrates a communication system of a radio communication terminal in accordance with the related art. As shown in FIG. 1, the related art communication system includes a radio communication terminal 1 having a passive antenna that transmits and receives an RF signal to and from an outside, and a base station 2 for transmitting the RF signal transmitted to and received from the radio communication terminal to a certain communication network through a cable network.

The radio communication terminal 1 forms a radio communication link by using a dipole antenna 3 which is inexpensive and does not assume a direction if a radio environment is favorable, or forms a radio communication link by using a directional antenna which has a direction toward the base station 2 where it is far away from the base station or the radio environment is not good. At this time, a communication path between the radio communication terminal 1 and the directional antenna 4 is implemented by a transmission line 5.

Generally, with its gain of some 2.5 dBi and omnidirectional radiation characteristics, the dipole antenna is designed to be adapted to the mobile communication. With such a low gain, the dipole antenna is not suitable for a fixed radio communication terminal. Thus, for the radio communication terminal, usually, it is connected to the directional antenna through the transmission line with a certain length and the directional antenna is installed outdoors or indoors to form a radio communication link. However, the directional antenna has a problem that its speech quality is degraded due to losses generated and attributed to the transmission line.

In the related art communication system of the radio communication terminal, since the dipole antenna and the directional antenna are passive type, a performance of the antenna is determined depending on a performance of the radio communication terminal. In addition, although the directional antenna has a better direction property than that of the dipole antenna, its speech quality is deteriorated due to the loss generated at the transmission line. Since the antenna characteristics are passive, there are limitations in improving the speech quality.

SUMMARY OF THE INVENTION

One exemplary embodiment of the present invention is to provide an active antenna system of a radio communication terminal that is capable of providing an enhanced speech quality by combining and integrating an antenna and an amplifying unit.

Another exemplary embodiment provides an active antenna system of a radio communication terminal that is capable of improving a speech quality of a radio communication terminal in an area where a radio environment is not good by improving a transmission output and a reception sensitivity of the radio communication terminal by using an active antenna.

Another exemplary embodiment provides an active antenna system of a radio communication terminal including: a directional antenna for transmitting and receiving an RF signal to and from a base station through a radio link; and an amplifying unit integrated on one board together with the directional antenna and amplifying and filtering the RF signal.

To achieve at least these advantages in whole or in parts, there is further provided an active antenna system of a radio communication terminal including; a directional antenna for transmitting and receiving an RF signal to and from a base station; a sending end amplifying/filtering unit for amplifying and filtering an RF signal to be transmitted through a duplexer; a receiving end amplifying/filtering unit for amplifying and filtering the RF signal received through the duplexer; a closed loop control circuit for generating a control signal according to power of a transmission RF signal outputted from the sending end amplifying/filtering unit; and a bias unit for separating the RF signal and a DC power transmitted from a radio communication terminal through a transmission line.

To achieve at least these advantages in whole or in parts, there is further provided an active antenna system of a radio communication terminal including; a directional antenna for transmitting and receiving an RF signal to and from a base station; a sending end amplifying/filtering unit for amplifying and filtering a transmission RF signal; a receiving end amplifying/filtering unit for amplifying and filtering a reception RF signal; and a bias unit for separating an RF signal, a DC power and a control signal transmitted from the radio communication terminal through a transmission line.

In another embodiment, an active antenna system of a radio communication terminal includes an antenna that transmits and receives a communication signal to and from a communication node through a communication link; and an amplifying unit integrated on one board together with the antenna and amplifying and filtering the communication signal.

In another embodiment, a radio communication method include transmitting and receiving a communication signal in an antenna to and from a communication node through a communication link; and amplifying and filtering the communication signal in an amplifying unit integrated on one board together with the antenna.

In another embodiment, a radio communication method includes transmitting and receiving an RF signal in a directional antenna to and from a communication node. Amplifying and filtering an RF signal in a sending end amplifying/filtering unit to be transmitted through a duplexer and amplifying and filtering the RF signals in a receiving end amplifying filtering unit through the duplexer. A closed loop control circuit generates a control signal according to power of a transmission RF signal outputted from a sending end amplifying/filtering unit and a bias unit that separates the RF signal and a DC power transmitted from a radio communication terminal through a transmission line.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

An active antenna system of a radio communication terminal in accordance with various embodiments of the present invention will now be described with reference to the accompanying drawings.

Figure 1:
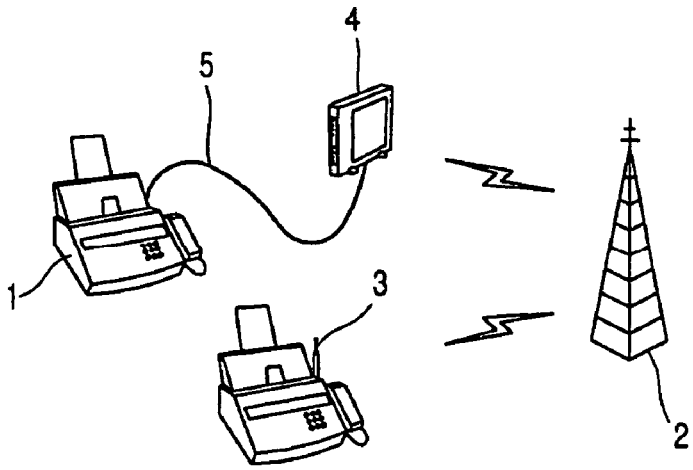
FIG. 1 illustrates a communication system of a radio communication system in accordance with the related art.
Figure 2:
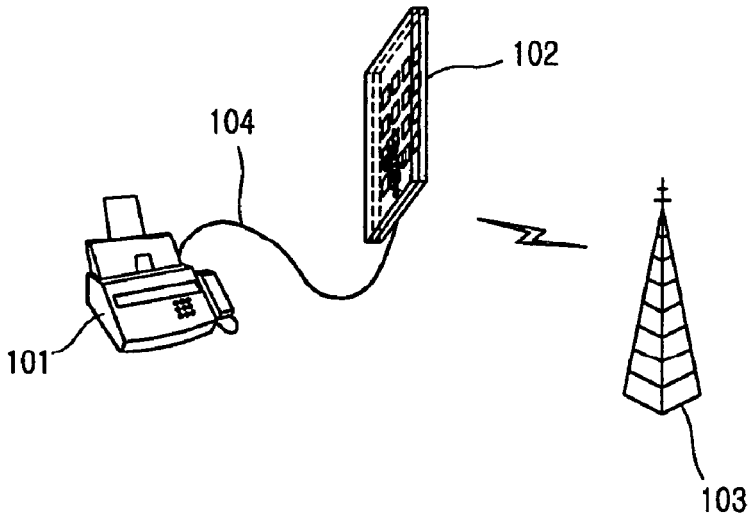
FIG. 2 illustrates a communication system of a radio communication terminal in accordance with an embodiment of the present invention.

FIG. 2 illustrates a communication system of a radio communication terminal in accordance with the present invention. As shown in FIG. 2, an active antenna 102, a combination of a directional antenna and an amplifying unit, is connected to a fixed radio communication terminal 101 through a transmission line 104, and a radio communication link is formed between the active antenna 102 and a base station 103.

Figure 3A:
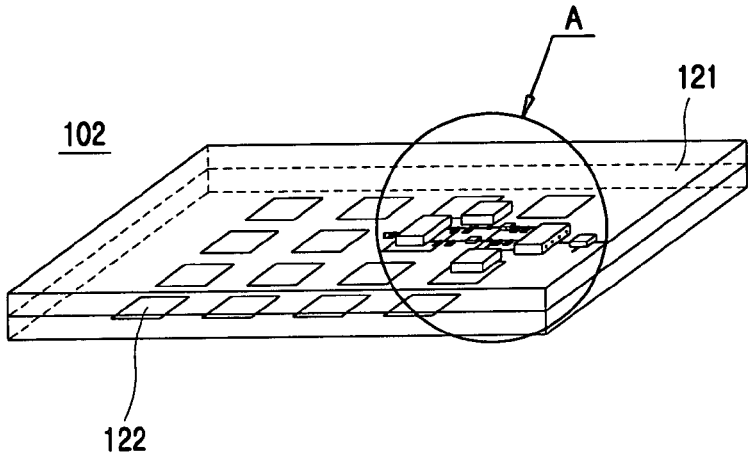
FIG. 3A is a perspective view showing an active antenna system of a radio communication terminal in accordance with an embodiment of the present invention.
Figure 3B:
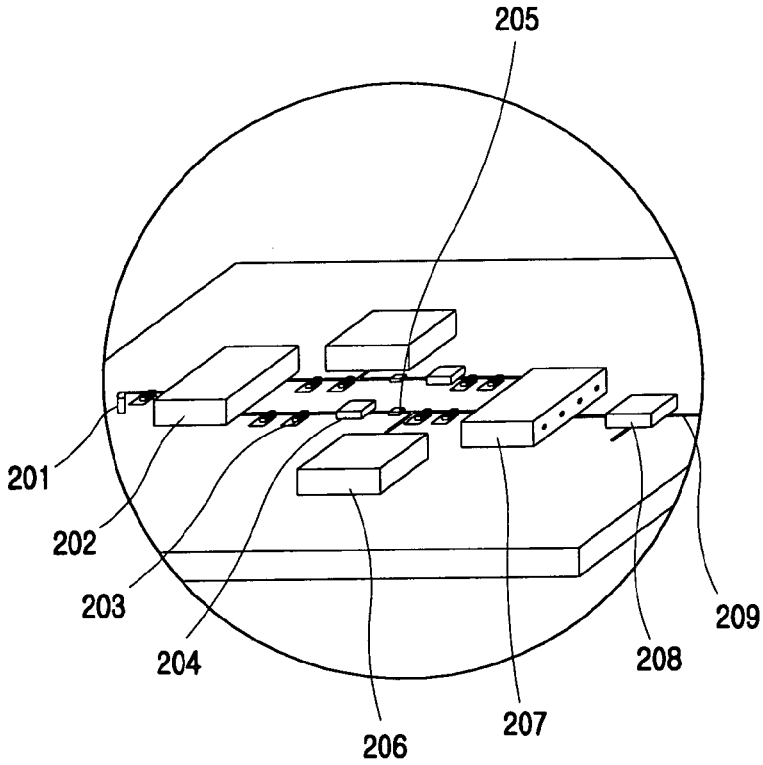
FIG. 3B is an enlarged perspective view showing a portion of FIG. 3A.

FIGS. 3A and 3B are detailed views of the active antenna system of the radio communication terminal as illustrated in FIG. 2, of which FIG. 3A is a perspective view showing an active antenna in accordance with the present invention and FIG. 3B is an enlarged view of a portion 'A' of FIG. 3A. In one embodiment, the present invention uses a micro strip patch array antenna among directional antennas.

As shown in FIG. 3A, a plurality of micro strip patch antennas 122 are arranged at one side of a dielectric board 121, and an amplifying unit (A) is integrated at the other side of the dielectric board 121, the opposite of the side on which the micro strip patch antennas 122 are arranged. That is, by integrating the micro strip patch array antenna and the amplifying unit (A) at one board 121, a loss generated at the transmission line can be reduced.

Referring to the amplifying unit, as shown in FIG. 3B, the amplifying unit is divided into a transmitter and a receiver, which include a matching unit 203, an amplifier 204, a filter 205 and a power source unit 206, respectively. The transmitter and the receiver share two transmission and reception separating duplexers 202 and 207, antenna feeder 201, a bias-T 208 and a transmission line 209.

The bias-T 208 separates an RF signal inputted through the transmission line 209 and a DC power, with which no power supplying cable is necessary additionally. In particular, a modified bias-T is proposed in the present invention which includes a band pass filter. The modified bias-T can separate a signal inputted through the transmission line into an RF signal, a control signal and a DC voltage. That is, the signal inputted to the modified bias-T contains the control signal as well as the RF signal and the DC voltage.

Figure 4:
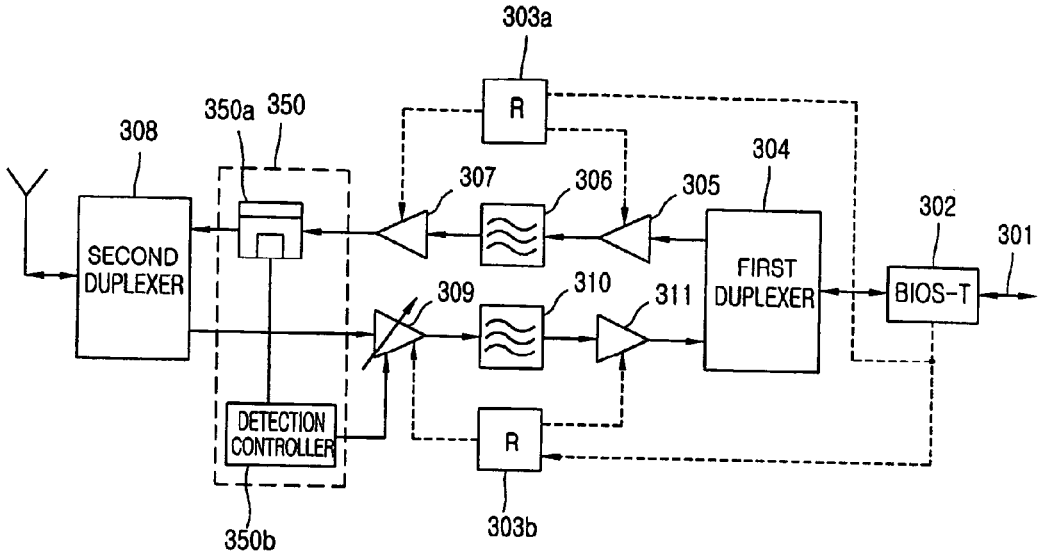
FIG. 4 illustrates an active antenna system of a radio communication terminal in accordance with an embodiment of the present invention.

FIG. 4 is a block diagram of an active antenna system of a radio communication terminal in accordance with one embodiment of the present invention, to which a closed loop is applied. As shown in FIG. 4, in the active antenna comprising of the transmitter and the receiver, the transmitter and the receiver include amplifiers 305, 307, 309 and 311, filters 306 and 310, and power supply units 303*a* and 303*b* supplying power to the amplifiers 305, 307, 309 and 311, respectively, and are connected to the antenna and the transmission line 301 through duplexers 302 and 308.

The active antenna includes a closed loop control circuit 350 for outputting a control signal according to power outputted from the amplifier 307 of the transmitter and a bias-T 302 for separating an RF signal and a DC power from a signal inputted through the transmission line 301.

The closed loop control circuit 350 includes a coupler 350*a* for coupling outputs of the amplifier 307 of the transmitter, and a detection controller 350*b* for detecting the output of the amplifier 307 through the coupler 350*a* and outputting a control signal.

The operation of the active antenna system of a radio communication terminal will now be described with reference to the accompanying drawings. In case of externally transmitting an RF signal, the RF signal is inputted to the active antenna through the transmission line 301 from the radio communication terminal. At this time, a DC power for driving the active antenna, as well as the RF signal, is also supplied to the transmission line 301 simultaneously.

The DC power transmitted to the transmission line 301 is separated from the RF signal by the bias-T 302 and supplied to the first power supply unit 303*a* of the active antenna. The first power supply unit 303*a* supplies the DC power as a driving power to the first amplifier 305 and the second amplifier 307.

The RF signal separated from the bias-T 302 is filtered by the first duplexer 304 and inputted to the first amplifier 305 of the transmitter, and the RF signal outputted from the first amplifier 305 is amplified through the first filter 306 and the second amplifier 307 and transmitted to the second duplexer 308. The RF signal transmitted to the second duplexer 308 is fed to the micro strip patch antenna 122 by way of the antenna feeder 201 (FIG. 3B). The micro strip patch antenna 122 transmits the corresponding RF signal in the air.

In case of receiving an RF signal, the transmission process as described above is performed reversely as follows. An RF signal received through the micro strip patch antenna 122 is filtered through the second duplexer 308 and inputted to the third amplifier 309 of a receiving end. The RF signal outputted from the third amplifier 309 is amplified through the second filter 310 and the fourth amplifier 311 and transmitted to the first duplexer 304. At this time, the third and fourth amplifiers 309 and 311 are driven by a DC power supplied to the second power supply unit 303*b* by way of the transmission line 301, like the first and second amplifiers 305 and 307. The first and second amplifiers 305 and 307 of the transmitter are power amplifier, while the third and the fourth amplifiers 309 and 311 of the receiver are a variable gain low noise amplifier and a fixed gain low noise amplifier. That is, a gain of the third amplifier 309 is varied according to a control signal outputted from the detection controller 350*b*.

In the process of transmitting and receiving the RF signal, the closed loop control circuit 350 is used to allow the radio communication terminal to maintain a certain level of speech quality. The closed loop control circuit 350 branches the output of the second amplifier 307 of the transmitter by means of the coupler 350*a* and detects a transmission power by means of the detection controller 350*b*.

The closed loop control circuit 350 allows the power amplifier of the transmitter to maintain a constantly same gain and controls a gain of the variable gain low noise amplifier 309 of the receiver. For instance, if a transmission output of the transmitter increases, the detection controller 350*b* generates a corresponding DC power to increase the gain of the variable gain low noise amplifier 309 of the receiver. Meanwhile, if the transmission output of the transmitter decreases, the detection controller 350*b* reduces the gain of the variable gain low noise amplifier 309 of the receiver. That is, the detection controller 350 controls the gain depending on the output detected by the transmitter.

In this manner, the active antenna can maintain a speech quality at above a certain level by using the closed loop control. At this time, only the RF signal and DC power are applied to the transmission line 301 connected between the radio communication terminal and the active antenna, while no control signal is applied thereto.

Figure 5:
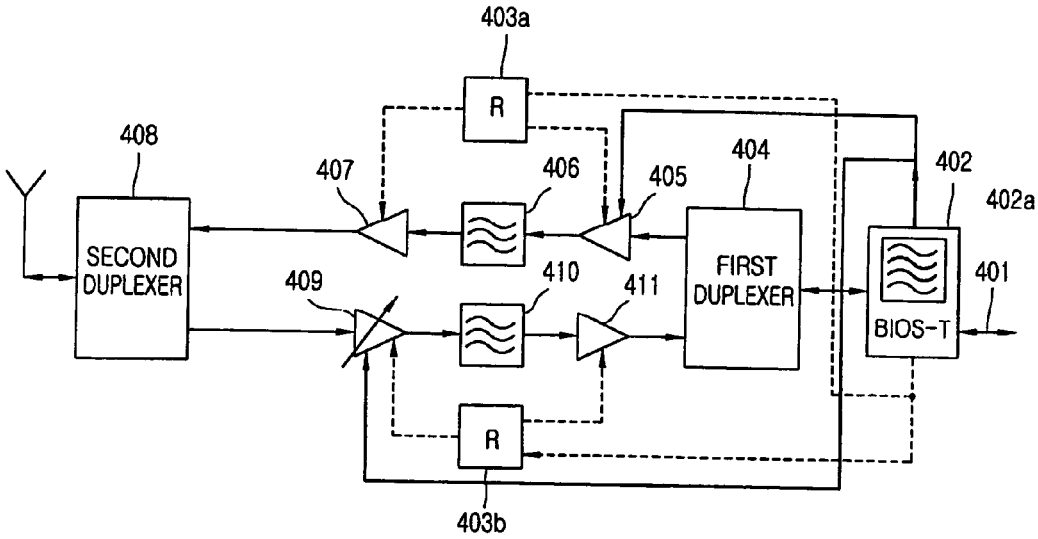
FIG. 5 illustrates an active antenna system of a radio communication terminal in accordance with an embodiment of the present invention.

FIG. 5 is a block diagram of an active antenna system of a radio communication terminal in accordance with a second embodiment of the present invention, in which a speech quality is maintained by performing a gain control without using the closed loop.

As shown in FIG. 5, a transmitter and a receiver include amplifiers 405, 407, 409 and 411, filters 406 and 410, and power supply units 403*a* and 403*b* supplying power to the amplifiers 405, 407, 409 and 411, and are connected to a transmission line 401 and an antenna through duplexers 404 and 408. The active antenna system includes a modified bias-T 402 for separating an RF signal, a DC power and a control signal from a signal inputted through the transmission line 401.

The modified bias-T 402 controls a gain of a variable gain power amplifier 405 and a gain of a variable gain low noise amplifier 409 inside the active antenna.

Figure 6A:
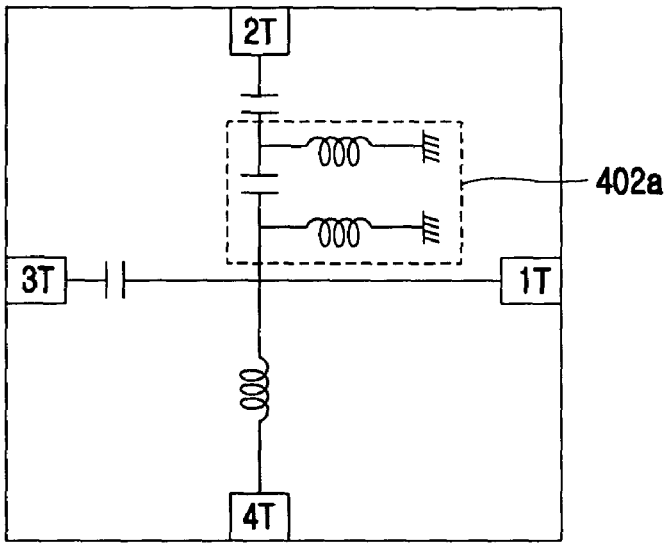
FIGS. 6A and 6B are a circuit diagram of a modified bias-T of the active antenna in accordance with an embodiment of the present invention and a graph showing characteristics of a control signal of the modified bias-T.
Figure 6B:
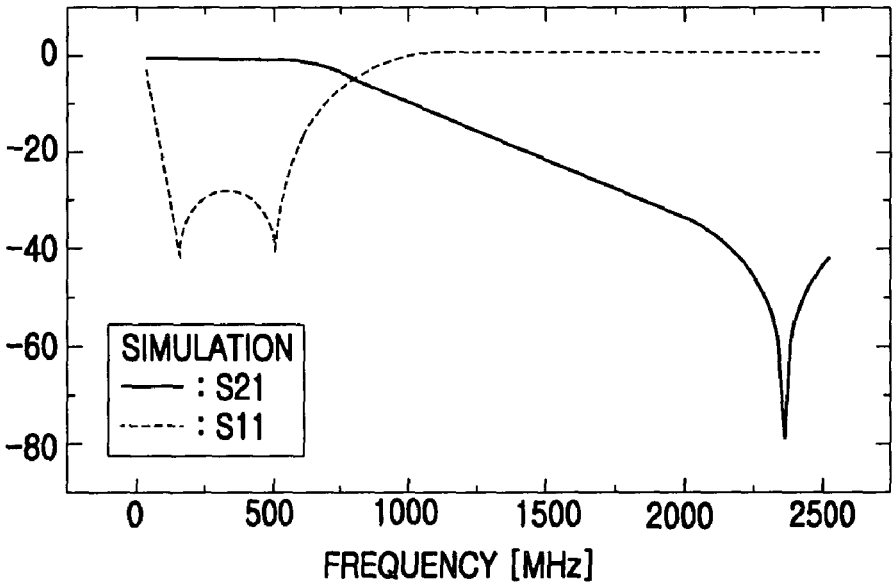

FIG. 6A illustrates the construction of the modified bias-T and FIG. 6B is a graph showing control signal line characteristics of the modified bias-T.

As shown in FIG. 6A, the modified bias-T 402 is constructed by adding a band pass filter 402*a* and a second terminal 2T for separating a path of a control signal to a bias-T which separates an RF signal and a DC power through a first terminal 1T, a third terminal 3T and a fourth terminal 4T. The first terminal is connected to the transmission line 401, the control signal is separated through the second terminal 2T, and the DC power and the RF signal are separated through third and fourth terminals 3T and 4T.

In the graph of FIG. 6B, it can be noted that the control signal S21 has good output characteristics in the frequency region of 0 to 500 MHz, while the RF signal (S11) has good output characteristics in the frequency region of 2000 to 2500 MHz.

If an intensity of a reception signal of the receiver is lowered down, the radio communication terminal generates a control signal to adjust a gain of the variable gain power amplifier 405 and a gain of the variable gain low noise amplifier 409 inside the active antenna system, and transmits the control signal through the transmission line 401. The control signal is transmitted to the variable gain power amplifier 405 and the variable gain low noise amplifier 409 of the transmitter and of the receiver inside the active antenna after passing through the band pass filter 402*a* of the bias-T 402, and controls gains of each amplifier. That is, the control signal as well as the RF signal and the DC power is also applied to the transmission line connected between the radio communication terminal and the active antenna.

In this manner, in the second embodiment of the present invention, the radio communication terminal directly controls the gain of the active antenna through the transmission line, according to which a speech quality of the radio communication terminal can be maintained by above a certain level.

As so far described above, the active antenna system of a radio communication terminal of the present invention has the following advantages.

That is, since the antenna and the amplifying unit are integrated, a loss can be minimized compared to the case that the antenna and the amplifying unit are separately designed and coupled, and a loss generated due to the transmission line between the antenna and the radio communication terminal can be compensated.

In addition, the gain of the active antenna system can be maintained to a certain level, so that a speech quality in an area remote from a base station can be maintained by above a certain level.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures. The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An antenna system of a radio communication terminal comprising:

an antenna that transmits and receives a communication signal to and from a communication node;

a sending end amplifying/filtering unit that amplifies and filters the communication signal to be transmitted through a duplexer;

a receiving end amplifying/filtering unit that amplifies and filters the communication signal received through a duplexer;

a closed loop control circuit that generates a control signal according to power of a communication signal output from sending end amplifying/filtering unit; and a bias unit that separated the communication signal and a power transmitted from a radio communication terminal through a transmission line, wherein the receiving end amplifying/filtering unit includes a variable amplifier that amplifies a reception communication signal as much as a variable gain according to a control signal, and wherein the closed loop control circuit comprises:

a coupling unit that branches a transmission output from a final end of the sending end amplifying/filtering unit; and a detection controller that generates a control signal according to a strength of power of the branched transmission output and applying the control signal to the variable gain amplifier.

2. The system of claim 1, wherein the duplexer separates a transmission path and a reception path of a communication signal at both ends of the sending end amplifying/filtering unit and the receiving end amplifying/filtering unit.

3. The system of claim 1, wherein the sending end amplifying/filtering unit and the receiving end amplifying/filtering unit comprise, respectively:

a plurality of amplifiers that amplifies a transmission signal and a reception signal;

a filter that filters each signal between amplifiers; and a power supply unit that supplies power to each amplifier.

4. The system of claim 3, wherein the power supply unit supplies a power transmitted from the bias unit.

5. The system of claim 1, wherein the control signal makes the transmission output and the gain of the variable gain amplifier to be proportional to each other.

6. The system of claim 1, wherein the bias unit further comprises a filter that passes a signal meeting a predetermined filtering criteria.

7. An antenna system of a radio communication terminal comprising:

an antenna that transmits and receives a communication signal to and from a communication node;

a sending end amplifying/filtering unit that amplifies and filters a transmission signal;

a receiving end amplifying/filtering unit that amplifies and filters a reception signal; and a bias unit that separates a communication signal, a power and a control signal transmitted from the radio communication terminal through a transmission line, wherein the control signal is applied to at least one of the sending and receiving end amplifying/filtering units to adjust a corresponding amplifier gain.

8. The system of claim 7, wherein the bias unit includes a band pass filter that passes a control signal among signals transmitted through the transmission line.

9. The system of claim 7, wherein the sending end amplifying/filtering unit and the receiving end amplifying/filtering unit are connected to a duplexer separating a transmission path and a reception path at both ends.

10. The system of claim 7, wherein the sending end amplifying/filtering unit and the receiving end amplifying/filtering unit comprise, respectively:

a plurality of amplifiers that amplify a transmission signal and a reception signal;

a filter that filters each signal between amplifiers; and a power supply unit that supplies power to each amplifier.

11. The system of claim 10, wherein the power supply unit supplies a power transmitted from the bias unit to the amplifier.

12. The system of claim 7, wherein at least one of the sending end amplifying/filtering unit and the receiving end amplifying/filtering unit include a variable gain amplifier that amplifies a reception signal as much as a variable gain according to a control signal.

13. A radio communication method comprising:

transmitting and receiving a communication signal in an antenna to and from a communication node;

amplifying and filtering a communication signal in a sending end amplifying/filtering unit to be transmitted through a duplexer;

amplifying and filtering the communication signals in a receiving end amplifying filtering unit through the duplexer;

generating a control signal according to power of a transmission communication signal outputted from the sending end amplifying/filtering unit; and separating the communication signal and a power transmitted from a radio communication terminal through a transmission line, wherein generating the control signal comprises:

branching a transmission output form a final end of the sending end amplifying/filtering unit; and generating the control signal according to a strength of power of the branched transmission output and variably controlling a gain of the receiving end amplifying/filtering unit based on the generated control signal.

14. The system of claim 1, wherein the antenna, the sending and receiving end amplifying and filtering units, the closed loop control circuit and the bias unit are mounted together on a same board.

15. The system of claim 7, wherein the antenna, the sending and receiving end amplifying and filtering units, the closed loop control circuit and the bias unit are mounted together on a same board.

* * * * *

UNITED STATES PATENT AND TRADEMARK OFFICE

CERTIFICATE OF CORRECTION

PATENT NO. : 7,071,884 B2
APPLICATION NO. : 10/649954
DATED : July 4, 2006
INVENTOR(S) : Tae-Kyu Choi It is certified that error appears in the above-identified patent and that said Letters Patent is hereby corrected as shown below:

Title page, item [54] and Col. 1, should read --
ACTIVE ANTENNA SYSTEM OF A RADIO COMMUNICATION TERMINAL --

Signed and Sealed this

Fourteenth Day of November, 2006

JON W. DUDAS
*Director of the United States Patent and Trademark Office*